US008133854B2

(12) United States Patent
Cermenati et al.

(10) Patent No.: US 8,133,854 B2
(45) Date of Patent: Mar. 13, 2012

(54) LIQUID ACIDIC HARD SURFACE CLEANING COMPOSITION

(75) Inventors: Laura Cermenati, Brussels (BE); Christopher Andrew Morrison, Genval (BE); William Mario Laurent Verstraeten, Herent (BE)

(73) Assignee: The Procter & Gamble Company, Cincinnati, OH (US)

( * ) Notice: Subject to any disclaimer, the term of this patent is extended or adjusted under 35 U.S.C. 154(b) by 0 days.

(21) Appl. No.: 12/430,234

(22) Filed: Apr. 27, 2009

(65) Prior Publication Data

US 2009/0270304 A1 Oct. 29, 2009

(30) Foreign Application Priority Data

Apr. 29, 2008 (EP) ..... 08155346

(51) Int. Cl.

| | |
|---|---|
| ***C11D 3/20*** | (2006.01) |
| ***C11D 3/37*** | (2006.01) |
| ***C11D 3/60*** | (2006.01) |
| ***C11D 7/26*** | (2006.01) |
| ***C23G 1/02*** | (2006.01) |
| ***B08B 7/00*** | (2006.01) |

(52) U.S. Cl. ..... 510/405; 510/108; 510/238; 510/239; 510/253; 510/362; 510/365; 510/488; 134/2; 134/41; 134/42

(58) Field of Classification Search ..... 510/405, 510/108, 238, 239, 253, 362, 365, 488; 134/2, 134/41, 42

See application file for complete search history.

(56) References Cited

U.S. PATENT DOCUMENTS

| | | | | |
|---|---|---|---|---|
| 4,246,130 | A | 1/1981 | Koch | |
| 4,469,525 | A * | 9/1984 | Dodge | 134/3 |
| 4,508,641 | A * | 4/1985 | Hanulik | 588/3 |
| 4,812,255 | A * | 3/1989 | Suwala | 134/38 |
| 5,106,525 | A * | 4/1992 | Sullivan | 510/206 |
| 6,172,028 | B1 * | 1/2001 | Baur et al. | 510/361 |
| 6,221,823 | B1 * | 4/2001 | Crisanti et al. | 510/238 |
| 6,453,914 | B2 * | 9/2002 | Torek et al. | 134/1.2 |
| 6,472,358 | B1 * | 10/2002 | Richter et al. | 510/234 |
| 6,524,624 | B1 * | 2/2003 | Morelli et al. | 424/665 |
| 6,569,261 | B1 * | 5/2003 | Aubay et al. | 134/39 |
| 6,699,828 | B1 * | 3/2004 | de Buzzaccarini et al. | 510/372 |
| 6,753,305 | B2 * | 6/2004 | Raso et al. | 510/438 |
| 6,916,493 | B2 * | 7/2005 | Morelli et al. | 424/665 |
| 6,936,579 | B2 * | 8/2005 | Urban | 510/412 |
| 7,094,742 | B2 * | 8/2006 | Gaudreault | 510/253 |
| 7,517,844 | B2 * | 4/2009 | Diet et al. | 510/238 |
| 7,718,590 | B2 * | 5/2010 | Suzuki et al. | 510/175 |
| 7,745,384 | B2 * | 6/2010 | Perry et al. | 510/253 |
| 2003/0083222 | A1 * | 5/2003 | Raso et al. | 510/463 |
| 2003/0121132 | A1 * | 7/2003 | Oh et al. | 29/29 |
| 2003/0180247 | A1 * | 9/2003 | Morelli et al. | 424/70.24 |
| 2005/0239676 | A1 * | 10/2005 | Gaudreault | 510/253 |
| 2005/0256018 | A1 * | 11/2005 | Keller et al. | 510/383 |
| 2006/0118759 | A1 * | 6/2006 | Klein et al. | 252/79.1 |
| 2008/0234170 | A1 * | 9/2008 | Diet et al. | 510/421 |

FOREIGN PATENT DOCUMENTS

| | | | |
|---|---|---|---|
| EP | 0 666 305 | A1 | 8/1995 |
| EP | 0 666 306 | A1 | 8/1995 |
| WO | WO 2004/108599 | A1 | 3/2004 |
| WO | WO 2008/015381 | * | 2/2008 |

OTHER PUBLICATIONS

PCT International Search Report, 4 pages, Mailed Aug. 10, 2009, (PCT/US2009/0417650).

* cited by examiner

*Primary Examiner* — Lorna M Douyon

(74) *Attorney, Agent, or Firm* — John T. Dipre; Amy I. Ahn-Roll

(57) ABSTRACT

The present invention relates to a liquid acidic hard surface cleaning composition comprising an acid system, wherein the acid system comprises formic acid and acetic acid.

18 Claims, No Drawings

LIQUID ACIDIC HARD SURFACE CLEANING COMPOSITION

FIELD OF THE INVENTION

The present invention relates to liquid compositions for cleaning a variety of hard surfaces such as hard surfaces found in around the house, such as bathrooms, toilets, garages, driveways, basements, gardens, kitchens, etc. More specifically, the compositions of the present invention deliver good limescale removal performance (i.e., removal of pure limescale deposits and/or limescale-containing soils) whilst having a good surface safety profile on the treated surface.

BACKGROUND OF THE INVENTION

Liquid compositions for cleaning hard-surfaces have been disclosed in the art. Much of the focus for such compositions has been on providing outstanding cleaning performances on a variety of soils and surfaces and, more particularly, to provide improved performance on the removal of limescale.

Indeed, one type of stains frequently occurring on hard surfaces found in bathrooms, toilets, garages, driveways, basements, gardens, kitchens, etc., are limescale deposits. Limescale deposits, are formed due to the fact that tap water contains a certain amount of solubilised ions, which upon water evaporation eventually deposit as salts such as calcium carbonate on hard surfaces, which are frequently in contact with water. The visible limescale deposits result in an unaesthetic aspect of the surfaces. The limescale formation and deposition phenomenon is even more acute in places where water is particularly hard. Furthermore, limescale deposits are prone to combination with other types of soils, such as soap scum or grease, and can lead to the formation of limescale-soil mixture deposits (limescale-containing soils). The removal of limescale deposits and limescale-containing soils is herein in general referred to as "limescale removal" or "removing limescale".

It is known to use acidic compositions to clean hard surfaces and that such formulations show good overall cleaning performance and good limescale removal performance. Indeed, for example WO 2004/018599 describes acidic hard surface cleaning compositions comprising an acid or a mixture thereof. Amongst the acids suitable in hard surface cleaning compositions, formic acid has been identified as one acid that provides good limescale removal performance.

However, there are some limitations to the convenience of acidic compositions employed as hard surface cleaner. Indeed, it is known that some hard surfaces, such as enamel and several metals, e.g. stainless steel and aluminum, are sensitive to acids and may be severely damaged by acidic compositions used to clean said surfaces. In particular, it has bee found that formic acid-based hard surface cleaner compositions show a surface safety profile that can still be further improved.

It is thus an objective of the present invention to provide a liquid, acidic hard surface cleaning composition that provides good limescale removal performance whilst showing a good surface safety profile on the treated surface. In particular, it is an objective of the present invention to provide a liquid hard surface cleaning composition comprising an acid system comprising formic acid and a second acid that provides a similar limescale removal performance as compared to compositions comprising formic acid alone or formic acid in combination with another acid (such as phosphoric acid) other than the second acid herein whilst having an improved surface safety profile on the treated surface as compared to such compositions comprising formic acid alone or formic acid in combination with another acid (such as phosphoric acid) other than the second acid herein.

It has been found that the above objective can be met by the composition according to the present invention.

It is an advantage of the compositions according to the present invention that they may be used to clean hard surfaces made of a variety of materials like glazed and non-glazed ceramic tiles, enamel, stainless steel, Inox®, Formica®, vinyl, no-wax vinyl, linoleum, melamine, glass, plastics.

A further advantage of the present invention is that the compositions herein are safe to consumers.

BACKGROUND ART

WO 2004/018599 describes acidic hard surface cleaning compositions comprising an acid or a mixture thereof.

EP-A-0 666 306 and EP-A-0 666 305 describe liquid compositions suitable for removing limescale from hard surfaces comprising maleic acid in combination with a second acid.

SUMMARY OF THE INVENTION

The present invention relates to a liquid acidic hard surface cleaning composition comprising an acid system, wherein the acid system comprises formic acid and acetic acid.

The present invention further encompasses a process of cleaning a hard surface or an object, preferably removing limescale from said hard-surface or said object, comprising the steps of: applying a liquid acidic hard surface cleaning composition according to the present invention onto said hard-surface or said object; leaving said composition on said hard-surface or said object to act; optionally wiping said hard-surface or object, and then rinsing said hard-surface or said object.

The present invention further encompasses the use, in a liquid acidic hard surface cleaning composition, of an acid system, wherein the acid system comprises formic acid and acetic acid, to provide limescale removal performance, whilst providing good surface safety to the treated hard surface.

DETAILED DESCRIPTION OF THE INVENTION

The Liquid Acidic Hard Surface Cleaning Composition

The compositions according to the present invention are designed as hard surfaces cleaners.

The compositions according to the present invention are liquid compositions as opposed to a solid or a gas.

The liquid acidic hard surface cleaning compositions according to the present invention are preferably aqueous compositions. Therefore, they may comprise from about 70% to about 99% by weight of the total composition of water, preferably from about 75% to about 95% and more preferably from about 80% to about 95%.

The compositions of the present invention are acidic. Indeed, they typically have a pH comprised between about 3 and about 4, preferably from about 3.1 to about 3.9, more preferably from about 3.2 to about 3.9, even more preferably about 3.5 to about 4.0, and most preferably from about 3.6 to about 3.9.

The pH of the cleaning compositions herein, as is measured at 25° C., is at least about 3, with increasing preference in the order given, about 3.1, 3.2, 3.3, 3.4, or 3.5. The pH of the cleaning compositions herein, as is measured at 25° C., is no more than about 4, preferably with increasing preference in the order given, about 4, 3.9, 3.8, 3.7 or 3.6.

Indeed, the Applicant has found that by using a composition having a pH comprised between about 3 and about 4, the pH of said composition is in an optimal range to achieve good cleaning performance whilst still being safe to the treated hard surface. Indeed, a composition having a pH below about 3 will be less safe to the treated hard surface and a composition having a pH above about 4 will be less performing in terms of cleaning hard surface.

The compositions herein may accordingly comprise an alkaline material. Indeed, an alkaline material may be present to trim the pH and/or maintain the pH of the compositions according to the present invention. Examples of alkaline material are sodium hydroxide, potassium hydroxide and/or lithium hydroxide, and/or the alkali metal oxides such, as sodium and/or potassium oxide or mixtures thereof and/or alkali metal carbonates or bicarbonates such as sodium or potassium carbonate/bicarbonate. Other suitable bases include ammonia, ammonium carbonate and hydrogen carbonate, choline base, etc. Preferably, source of alkalinity is sodium hydroxide or potassium hydroxide, preferably potassium hydroxide. Indeed, it has been found that potassium hydroxide, if present, further contributes to the improved surface safety profile of the compositions herein.

Typically the amount of alkaline material is of from about 0.001% to about 20% by weight, preferably from about 0.01% to about 10% and more preferably from about 0.1% to about 3% by weight of the composition.

Despite the presence of alkaline material, if any, the compositions herein would remain acidic compositions (i.e., formulated with a pH below 7).

In a preferred embodiment according to the present invention the compositions herein have a water-like viscosity. By "water-like viscosity" it is meant herein a viscosity that is close to that of water. Preferably the liquid acidic hard surface cleaning compositions herein have a viscosity of up to about 50 cps at 60 rpm, more preferably from about 0 cps to about 30 cps, yet more preferably from about 0 cps to about 20 cps and most preferably from about 0 cps to about 10 cps at 60 rpm[1] and 20° C. when measured with a Brookfield digital viscometer model DV II, with spindle 2.

In another preferred embodiment according to the present invention the compositions herein are thickened compositions. Thus, the liquid acidic hard surface cleaning compositions herein preferably have a viscosity of from about 50 cps to about 5000 cps at 20 $s^{-1}$, more preferably from about 50 cps to about 2000 cps, yet more preferably from about 50 cps to about 1000 cps and most preferably from about 50 cps to about 500 cps at 20 $s^{-1}$ and 20° C. when measured with a Rheometer, model AR 1000 (Supplied by TA Instruments) with a 4 cm conic spindle in stainless steal, 2° angle (linear increment from 0.1 to 100 $sec^{-1}$ in max. 8 minutes). Preferably, the thickened compositions according to this specific embodiment are shear-thinning compositions. The thickened liquid acidic hard surface cleaning compositions herein preferably comprise a thickener, more preferably a polysaccharide polymer (as described herein below) as thickener, still more preferably a gum-type polysaccharide polymer thickener and most preferably Xanthan gum.

In a preferred embodiment according to the present invention, are free of abrasive particulate components, preferably free of abrasive particulate components having hardness from 2 to 4 as measured according to the MOHS hardness scale. Indeed, the compositions according to the present invention are preferably not scouring compositions.

Acid System

The compositions according to the present invention comprise an acid system comprising formic acid and a second acid being acetic acid.

The compositions herein preferably comprise from about 0.11% to about 45%, preferably from about 2.5% to about 30%, more preferably from about 4% to about 21%, and most preferably from about 7% to about 13% by weight of the total composition of said acid system.

Formic Acid

The acid system present in the compositions herein comprises formic acid as a first component.

Formic acid has been found to provide excellent limescale removal performance.

Formic acid is commercially available from Aldrich.

The compositions of the present invention may comprise from about 0.01% to about 15%, preferably from about 0.5% to about 10%, more preferably from about 1% to about 8%, most preferably from about 1% to about 6% by weight of the total composition of formic acid.

Acetic Acid

The acid system present in the compositions herein comprises a second acid being acetic acid.

Suitable acetic acid is commercially available from Aldrich, ICI or BASF.

The compositions of the present invention may comprise from about 0.1 to about 30%, preferably from about 2% to about 20%, more preferably from about 3% to about 15%, most preferably from about 3% to about 10% by weight of the total composition of acetic acid.

It has been unexpectedly found that liquid aqueous acidic cleaning compositions comprising an acid system, wherein said acid system comprises formic acid and acetic acid, provide a similar limescale removal performance (i.e., limescale deposits cleaning performance and limescale-containing soil cleaning performance), as compared to the limescale removal performance obtained by a similar composition comprising formic acid alone or a combination of formic acid with an acid other than acetic acid, such as phosphoric acid. It has further been unexpectedly found that quid aqueous acidic cleaning compositions comprising an acid system, wherein said acid system comprises formic acid and acetic acid, provide an improved surface safety profile on the surface treated with the hard surface cleaning composition (i.e., the damage to the treated surface is reduced), as compared to the limescale removal performance obtained by a similar composition comprising formic acid alone or a combination of formic acid with an acid other than acetic acid, such as phosphoric acid.

The present invention also encompasses the use, in a liquid acidic hard surface cleaning composition, of an acid system, wherein the acid system comprises formic acid and acetic acid, to provide limescale removal performance whilst providing good surface safety to the treated hard surface.

In another preferred embodiment, the present invention is directed to the use as above described, wherein the good limescale removal performance is achieved when said composition is applied onto said hard surface or object, said composition is left on said hard surface or object to act, preferably with or without wiping and/or mechanical agitation action, and then said hard surface or object is rinsed.

In the use according to the present invention, said composition is left on said hard surface or object to act, preferably for an effective amount of time, more preferably for a period comprised between about 1 and about 10 minutes, most preferably for a period comprised between about 2 and about 4 minutes.

Optional Ingredients

The compositions according to the present invention may comprise a variety of optional ingredients depending on the technical benefit aimed for and the surface treated.

Suitable optional ingredients for use herein include chelating agents, nonionic surfactants, ferrous ion (and/or ferrous ion compounds), vinylpyrrolidone homopolymer or copolymer, polysaccharide polymer, radical scavengers, perfumes, surface-modifying polymers other than vinylpyrrolidone homo- or copolymers and polysaccharide polymers, solvents, other surfactants, builders, buffers, bactericides, hydrotropes, colorants, stabilizers, bleaches, bleach activators, suds controlling agents like fatty acids, enzymes, soil suspenders, brighteners, anti dusting agents, dispersants, pigments, and dyes.

Lactic Acid

As one preferred, but optional ingredient, the compositions herein comprise lactic acid.

It has been found that the presence of lactic acid additionally provides antimicrobial/disinfecting benefits to the compositions according to the present invention.

Lactic acid is commercially available from Aldrich or Purac.

The compositions according to the present invention may comprise up to about 10% by weight of the total composition of lactic acid, preferably from about 0.1% to about 6%, more preferably from about 0.2% to about 4%, even more preferably from about 0.2% to about 3%, and most preferably from about 0.5% to about 2%.

Chelating Agent

The compositions of the present invention may comprise a chelating agent or mixtures thereof, as a highly preferred optional ingredient. Chelating agents can be incorporated in the compositions herein in amounts ranging from about 0% to about 10% by weight of the total composition, preferably about 0.01% to about 5.0%, more preferably about 0.05% to about 1%.

Suitable phosphonate chelating agents to be used herein may include alkali metal ethane 1-hydroxy diphosphonates (HEDP), alkylene poly(alkylene phosphonate), as well as amino phosphonate compounds, including amino aminotri (methylene phosphonic acid) (ATMP), nitrilo trimethylene phosphonates (NTP), ethylene diamine tetra methylene phosphonates, and diethylene triamine penta methylene phosphonates (DTPMP). The phosphonate compounds may be present either in their acid form or as salts of different cations on some or all of their acid functionalities.

Preferred chelating agents to be used herein are diethylene triamine penta methylene phosphonate (DTPMP) and ethane 1-hydrox diphosphonate (HEDP). In a particularly preferred execution of the present invention, the chelating agent is selected to be ethane 1-hydroxy diphosphonate (HEDP). Such phosphonate chelating agents are commercially available from Monsanto under the trade name DEQUEST®.

Polyfunctionally-substituted aromatic chelating agents may also be useful in the compositions herein. See U.S. Pat. No. 3,812,044, issued May 21, 1974, to Connor et al., incorporated herein by reference. Preferred compounds of this type in acid form are dihydroxydisulfobenzenes such as 1,2-dihydroxy-3,5-disulfobenzene.

A preferred biodegradable chelating agent for use herein is ethylene diamine N,N'-disuccinic acid, or alkali metal, or alkaline earth, ammonium or substitutes ammonium salts thereof or mixtures thereof. Ethylenediamine N,N'-disuccinic acids, especially the (S,S) isomer have been extensively described in U.S. Pat. No. 4,704,233, Nov. 3, 1987, to Hartman and Perkins, incorporated herein by reference. Ethylenediamine N,N'-disuccinic acids is, for instance, commercially available under the tradename ssEDDS® from Palmer Research Laboratories.

Suitable amino carboxylates to be used herein include ethylene diamine tetra acetates, diethylene triamine pentaacetates, diethylene triamine pentaacetate (DTPA),N-hydroxyethylethylenediamine triacetates, nitrilotri-acetates, ethylenediamine tetrapropionates, triethylenetetraamine-hexa-acetates, ethanol-diglycines, propylene diamine tetracetic acid (PDTA) and methyl glycine di-acetic acid (MGDA), both in their acid form, or in their alkali metal, ammonium, and substituted ammonium salt forms. Particularly suitable amino carboxylates to be used herein are diethylene triamine penta acetic acid, propylene diamine tetracetic acid (PDTA) which is, for instance, commercially available from BASF under the trade name Trilon FS® and methyl glycine di-acetic acid (MGDA).

Further carboxylate chelating agents to be used herein include salicylic acid, aspartic acid, glutamic acid, glycine, malonic acid or mixtures thereof.

It has been surprisingly found that the addition of a chelating agent, preferably HEDP, in the composition of the present invention provides an unexpected improvement in terms of limescale removal. In the context of the present invention, it has been discovered that chelating agents, and in particular HEDP, further reduce the precipitation of slightly soluble calcium salts, by scavenging free calcium cations ($Ca^{2+}$). Without wishing to be bound by theory, it is further believed that a highly synergetic effect is achieved in terms of limescale removal performance, when a chelating agent, such as those described above, is combined with formic acid.

Nonionic Surfactant

The compositions of the present invention may preferably comprise a nonionic surfactant, or a mixture thereof. This class of surfactants may be desired as it further contributes to cleaning performance of the hard surface cleaning compositions herein. It has been found in particular that nonionic surfactants strongly contribute in achieving highly improved performance on greasy soap scum removal.

The compositions according to the present invention may comprise up to about 15% by weight of the total composition of a nonionic surfactant or a mixture thereof, preferably from about 0.1% to about 15%, more preferably from about 1% to about 10%, even more preferably from about 1% to about 5%, and most preferably from about 1% to about 3%.

Suitable nonionic surfactants for use herein are alkoxylated alcohol nonionic surfactants, which can be readily made by condensation processes which are well-known in the art. However, a great variety of such alkoxylated alcohols, especially ethoxylated and/or propoxylated alcohols, is conveniently commercially available. Surfactants catalogs are available which list a number of surfactants, including nonionics.

Accordingly, preferred alkoxylated alcohols for use herein are nonionic surfactants according to the formula RO(E)e(P)pH where R is a hydrocarbon chain of from about 2 to about 24 carbon atoms, E is ethylene oxide and P is propylene oxide, and e and p which represent the average degree of, respectively ethoxylation and propoxylation, are of from about 0 to about 24 (with the sum of e+p being at least about 1). Preferably, the hydrophobic moiety of the nonionic compound can be a primary or secondary, straight or branched alcohol having from 8 to about 24 carbon atoms.

Preferred nonionic surfactants for use in the compositions according to the invention are the condensation products of ethylene oxide and/or propylene oxide with alcohols having a straight or branched alkyl chain, having from about 6 to about 22 carbon atoms, wherein the degree of alkoxylation (ethoxylation and/or propoxylation) is from about 1 to about 15, preferably from about 5 to about 12. Such suitable nonionic surfactants are commercially available from Shell, for instance, under the trade name Neodol® or from BASF under the trade name Lutensol®.

Vinylpyrrolidone Homopolymer or Copolymer

The compositions of the present invention may optionally comprise a vinylpyrrolidone homopolymer or copolymer, or a mixture thereof. Typically, the compositions of the present invention may comprise from about 0.01% to about 5% by weight of the total composition of a vinylpyrrolidone homopolymer or copolymer, or a mixture thereof, more preferably from about 0.05% to about 3% and most preferably from 0. about 05% to about 1%.

Suitable vinylpyrrolidone homopolymers for use herein are homopolymers of N-vinylpyrrolidone having the following repeating monomer:

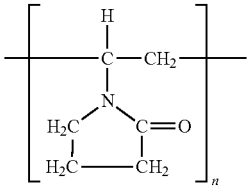

wherein n (degree of polymerisation) is an integer of from about 10 to about 1,000,000, preferably from about 20 to about 100,000, and more preferably from about 20 to about 10,000.

Accordingly, suitable vinylpyrrolidone homopolymers ("PVP") for use herein have an average molecular weight of from about 1,000 to about 100,000,000, preferably from about 2,000 to about 10,000,000, more preferably from about 5,000 to about 1,000,000, and most preferably from about 50,000 to about 500,000.

Suitable vinylpyrrolidone homopolymers are commercially available from ISP Corporation, New York, N.Y. and Montreal, Canada under the product names PVP K-15® (viscosity molecular weight of 10,000), PVP K-30® (average molecular weight of 40,000), PVP K-60® (average molecular weight of 160,000), and PVP K-90® (average molecular weight of 360,000). Other suitable vinylpyrrolidone homopolymers which are commercially available from BASF Cooperation include Sokalan HP 165®, Sokalan HP 12®, Luviskol K30®, Luviskol K60®, Luviskol K80®, Luviskol K90®; vinylpyrrolidone homopolymers known to persons skilled in the detergent field (see for example EP-A-262,897 and EP-A-256,696, both of which are incorporated herein by reference).

Suitable copolymers of vinylpyrrolidone for use herein include copolymers of N-vinylpyrrolidone and alkylenically unsaturated monomers or mixtures thereof.

The alkylenically unsaturated monomers of the copolymers herein include unsaturated dicarboxylic acids such as maleic acid, chloromaleic acid, fumaric acid, itaconic acid, citraconic acid, phenylmaleic acid, aconitic acid, acrylic acid, N-vinylimidazole and vinyl acetate. Any of the anhydrides of the unsaturated acids may be employed, for example acrylate, methacrylate. Aromatic monomers like styrene, sulphonated styrene, alpha-methyl styrene, vinyl toluene, t-butyl styrene and similar well known monomers may be used.

For example particularly suitable N-vinylimidazole N-vinylpyrrolidone polymers for use herein have an average molecular weight range from about 5,000 to about 1,000,000, preferably from about 5,000 to about 500,000, and more preferably from about 10,000 to about 200,000. The average molecular weight range was determined by light scattering as described in Barth H. G. and Mays J. W. Chemical Analysis Vol 113, "Modern Methods of Polymer Characterization", incorporated herein by reference.

Such copolymers of N-vinylpyrrolidone and alkylenically unsaturated monomers like PVP/vinyl acetate copolymers are commercially available under the trade name Luviskol® series from BASF.

According to a very preferred execution of the present invention, vinylpyrrolidone homopolymers are advantageously selected.

Polysaccharide Polymer

The compositions of the present invention may optionally comprise a polysaccharide polymer or a mixture thereof. Typically, the compositions of the present invention may comprise from about 0.01% to about 5% by weight of the total composition of a polysaccharide polymer or a mixture thereof, more preferably from about 0.05% to about 3% and most preferably from about 0.05% to about 1%.

Suitable polysaccharide polymers for use herein include substituted cellulose materials like carboxymethylcellulose, ethyl cellulose, hydroxyethyl cellulose, hydroxypropyl cellulose, hydroxymethyl cellulose, succinoglycan and naturally occurring polysaccharide polymers like Xanthan gum, gellan gum, guar gum, locust bean gum, tragacanth gum or derivatives thereof, or mixtures thereof.

In a preferred embodiment according to the present invention the compositions of the present invention comprise a polysaccharide polymer selected from the group consisting of: carboxymethylcellulose, ethyl cellulose, hydroxyethyl cellulose, hydroxypropyl cellulose, hydroxymethyl cellulose, succinoglycan gum, Xanthan gum, gellan gum, guar gum, locust bean gum, tragacanth gum, derivatives of the aforementioned, and mixtures thereof. Preferably, the compositions herein comprise a polysaccharide polymer selected from the group consisting of: succinoglycan gum, Xanthan gum, gellan gum, guar gum, locust bean gum, tragacanth gum, derivatives of the aforementioned, and mixtures thereof. More preferably, the compositions herein comprise a polysaccharide polymer selected from the group consisting of: Xanthan gum, gellan gum, guar gum, derivatives of the aforementioned, and mixtures thereof. Most preferably, the compositions herein comprise Xanthan gum, derivatives thereof, or mixtures thereof.

Particularly polysaccharide polymers for use herein are Xanthan gum and derivatives thereof. Xanthan gum and derivatives thereof may be commercially available for instance from CP Kelco under the trade name Keltrol RD®, Kelzan S® or Kelzan T®. Other suitable Xanthan gums are commercially available by Rhodia under the trade name Rhodopol T® and Rhodigel X747®. Succinoglycan gum for use herein is commercially available by Rhodia under the trade name Rheozan®.

It has surprisingly been found that the polysaccharide polymers or mixtures thereof herein act as surface modifying polymers (preferably combined with a vinylpyrrolidone homopolymer or copolymer, as described herein) and/or as thickening agents. Indeed, the polysaccharide polymers or mixtures thereof herein can be used to thicken the compositions according to the present invention. It has been surprisingly found that the use of polysaccharide polymers or mixtures thereof herein, and preferably Xanthan gum, provides excellent thickening performance to the compositions herein. Moreover, it has been found that the use of polysaccharide polymers or mixtures thereof herein, and preferably Xanthan gum, provides excellent thickening whilst not or only marginally reducing the limescale removal performance. Indeed, thickened compositions usually tend to show a drop in soil/stain removal performance (which in turn requires an increased level of actives to compensate for the performance drop) due to the thickening. It has been found that this is due to the fact that the actives providing the soil/stain removal performance are less free to migrate to the soil/stain. However, it has been surprisingly found that when polysaccharide polymers or mixtures thereof herein, and preferably Xanthan gum, are used as thickeners for the compositions herein, the drop in soil/stain removal performance is substantially reduced or even prevented.

Furthermore, without intended to be bound by theory, it has been shown that vinylpyrrolidone homopolymers or copolymers, preferably the vinylpyrrolidone homopolymer, and polysaccharide polymers, preferably Xanthan gum or derivatives thereof, described herein, when added into an aqueous acidic composition deliver improved shine to the treated surface as well as improved next-time cleaning benefit on said surface, while delivering good first-time hard-surface cleaning performance and good limescale removal performance. Furthermore, the formation of watermarks and/or limescale deposits upon drying is reduced or even eliminated.

Moreover, the vinylpyrrolidone homopolymers or copolymers and polysaccharide polymers further provide long lasting protection against formation of watermarks and/or deposition of limescale deposits, hence, long lasting shiny surfaces.

An additional advantage related to the use of the vinylpyrrolidone homopolymers or copolymers and polysaccharide polymers, in the acidic compositions herein, is that as they adhere on hard surface making them more hydrophilic, the surfaces themselves become smoother (this can be perceived by touching said surfaces) and this contributes to convey perception of surface perfectly descaled.

Advantageously, these benefits are obtained at low levels of vinylpyrrolidone homopolymers or copolymers and polysaccharide polymers, preferably Xanthan gum or derivatives thereof, described herein, thus it is yet another advantage of the present invention to provide the desired benefits at low cost.

Other Surface-Modifying Polymer

The compositions herein may further comprise a surface-modifying polymer other than the vinylpyrrolidone homo- or copolymers and polysaccharide polymers described herein above.

The composition herein may comprise up to 5%, more preferably of from about 0.0001% to about 3%, even more preferably of from about 0.001% to about 2%, and most preferably of from about 0.01% to about 1%, by weight of the total composition of said other surface-modifying polymers.

Other surface-modifying polymers are preferred optional ingredients herein as they deposit onto the surfaces cleaned with a composition according to the present invention. Thereby, soil adherence, soap scum, limescale and/or mineral encrustation build-up, is prevented.

Suitable other surface-modifying polymers may be selected from the group consisting of zwitterionic surface modification copolymers consisting of carboxylate- and permanent cationic-moieties; zwitterionic surface modifying polysulphobetaine copolymers; zwitterionic surface modifying polybetaine copolymers; silicone glycol polymers; and mixtures thereof.

Zwitterionic surface modification copolymers consisting of carboxylate- and permanent cationic-moieties, zwitterionic surface modifying polysulphobetaine copolymers and zwitterionic surface modifying polybetaine copolymers are described in WO 2004/083354, EP-A-1196523 and EP-A-1196527, all of which are incorporated herein by reference. Suitable zwitterionic surface modification copolymers consisting of carboxylate- and permanent cationic-moieties, zwitterionic surface modifying polysulphobetaine copolymers and zwitterionic surface modifying polybetaine copolymers are commercially available from Rhodia in the Mirapol SURF S-polymer series.

Alternative surface modification copolymers are described in the Applicant's co-pending European Patent Applications 07 113 156.9 (incorporated herein by reference), these copolymers are sulphobetaine/vinyl-pyrrolidone and its derivatives copolymers. A particularly suitable sulphobetaine/vinyl-pyrrolidone and its derivatives copolymer is a copolymer of 90% moles of vinyl pyrrolidone and 10% moles of SPE (sulphopropyl dimethyl ammonium ethyl methacrylate) such as exemplified in Example 1.1 of the Applicant's co-pending European Patent Applications 07 113 156.9 (incorporated herein by reference).

Suitable silicone glycols are described in the Applicant's co-pending European Patent Applications 03 447 099.7 and 03 447 098.9, in the section titled "Silicone glycol", incorporated herein by reference.

Silicone glycol polymers are commercially available from General electric, Dow Corning, and Witco (see European Patent Applications 03 447 099.7 and 03 447 098.9 for an extensive list of trade names of silicone glycol polymers, incorporated herein by reference).

In a highly preferred embodiment according to the present invention, the silicone glycol polymer herein is a Silicones-Polyethers copolymer, commercially available under the trade name SF 1288® from GE Bayer Silicones.

Radical Scavenger

The compositions of the present invention may further comprise a radical scavenger or a mixture thereof.

Suitable radical scavengers for use herein include the well-known substituted mono and dihydroxy benzenes and their analogs, alkyl and aryl carboxylates and mixtures thereof. Preferred such radical scavengers for use herein include di-tert-butyl hydroxy toluene (BHT), hydroquinone, di-tert-butyl hydroquinone, mono-tert-butyl hydroquinone, tert-butyl-hydroxy anysole, benzoic acid, toluic acid, catechol, t-butyl catechol, benzylamine, 1,1,3-tris(2-methyl-4-hydroxy-5-t-butylphenyl) butane, n-propyl-gallate or mixtures thereof and highly preferred is di-tert-butyl hydroxy toluene. Such radical scavengers like N-propyl-gallate may be commercially available from Nipa Laboratories under the trade name Nipanox S1®.

Radical scavengers, when used, may be typically present herein in amounts up to about 10% by weight of the total composition and preferably from about 0.001% to about 0.5% by weight. The presence of radical scavengers may contribute to the chemical stability of the compositions of the present invention.

Perfume

Suitable perfume compounds and compositions for use herein are for example those described in EP-A-0 957 156 under the paragraph entitled "Perfume", on page 13, incorporated herein by reference. The compositions herein may comprise a perfume ingredient, or mixtures thereof, in amounts up to about 5.0% by weight of the total composition, preferably in amounts of about 0.1% to about 1.5%.

Solvent

The compositions of the present invention may further comprise a solvent or a mixture thereof, as an optional ingredient. Solvents to be used herein include all those known to those skilled in the art of hard-surfaces cleaner compositions. In a highly preferred embodiment, the compositions herein comprise an alkoxylated glycol ether (such as n-Butoxy Propoxy Propanol (n-BPP)) or a mixture thereof.

Typically, the compositions of the present invention may comprise from about 0.1% to about 5% by weight of the total composition of a solvent or mixtures thereof, preferably from about 0.5% to about 5% by weight of the total composition and more preferably from about 1% to about 3% by weight of the total composition.

Additional Surfactant

The compositions of the present invention may comprise an additional surfactant, or mixtures thereof, on top of the nonionic surfactant already described herein. Additional surfactants may be desired herein as they further contribute to the cleaning performance and/or shine benefit of the compositions of the present invention. Surfactants to be used herein include anionic surfactants, cationic surfactants, amphoteric surfactants, zwitterionic surfactants, and mixtures thereof.

Accordingly, the compositions according to the present invention may comprise up to 15% by weight of the total composition of another surfactant or a mixture thereof, on top of the anionic surfactant already described herein, more preferably from about 0.5% to about 5%, even more preferably from about 0.5% to about 3%, and most preferably from about 0.5% to about 2%. Different surfactants may be used in the present invention including anionic, cationic, zwitterionic or amphoteric surfactants. It is also possible to use mixtures of such surfactants without departing from the spirit of the present invention.

Preferred surfactants for use herein are anionic and zwitterionic surfactants since they provide excellent grease soap scum cleaning ability to the compositions of the present invention.

Anionic surfactants may be included herein as they contribute to the cleaning benefits of the hard-surface cleaning compositions of the present invention. Indeed, the presence of an anionic surfactant contributes to the greasy soap scum cleaning of the compositions herein. More generally, the presence of an anionic surfactant in the liquid acidic compositions according to the present invention allows to lower the surface tension and to improve the wettability of the surfaces being treated with the liquid acidic compositions of the present invention. Furthermore, the anionic surfactant, or a mixture thereof, helps to solubilize the soils in the compositions of the present invention.

Suitable anionic surfactants for use herein are all those commonly known by those skilled in the art. Preferably, the anionic surfactants for use herein include alkyl sulphonates, alkyl aryl sulphonates, or mixtures thereof.

Particularly suitable linear alkyl sulphonates include C8 sulphonate like Witconate® NAS 8 commercially available from Witco.

Other anionic surfactants useful herein include salts (including, for example, sodium, potassium, ammonium, and substituted ammonium salts such as mono-, di- and triethanolamine salts) of soap, alkyl sulphates, alkyl aryl sulphates alkyl alkoxylated sulphates, C8-C24 olefinsulfonates, sulphonated polycarboxylic acids prepared by sulphonation of the pyrolyzed product of alkaline earth metal citrates, e.g., as described in British patent specification No. 1,082,179; alkyl ester sulfonates such as C14-16 methyl ester sulfonates; acyl glycerol sulfonates, alkyl phosphates, isethionates such as the acyl isethionates, N-acyl taurates, alkyl succinamates, acyl sarcosinates, sulfates of alkylpolysaccharides such as the sulfates of alkylpolyglucoside (the nonionic nonsulfated compounds being described below), alkyl polyethoxy carboxylates such as those of the formula RO(CH2CH2O)kCH2COO-M+ wherein R is a C8-C22 alkyl, k is an integer from 0 to 10, and M is a soluble salt-forming cation. Resin acids and hydrogenated resin acids are also suitable, such as rosin, hydrogenated rosin, and resin acids and hydrogenated resin acids present in or derived from tall oil. Further examples are given in "Surface Active Agents and Detergents" (Vol. I and II by Schwartz, Perry and Berch). A variety of such surfactants are also generally disclosed in U.S. Pat. No. 3,929,678, issued Dec. 30, 1975 to Laughlin, et al. at Column 23, line 58 through Column 29, line 23, incorporated herein by reference.

Suitable zwitterionic surfactants for use herein contain both basic and acidic groups which form an inner salt giving both cationic and anionic hydrophilic groups on the same molecule at a relatively wide range of pH's. The typical cationic group is a quaternary ammonium group, although other positively charged groups like phosphonium, imidazolium and sulfonium groups can be used. The typical anionic hydrophilic groups are carboxylates and sulfonates, although other groups like sulfates, phosphonates, and the like can be used.

Some common examples of zwitterionic surfactants (i.e. betaine/sulphobetaine) are described in U.S. Pat. Nos. 2,082,275, 2,702,279 and 2,255,082, all of which are incorporated herein by reference.

Examples of particularly suitable alkyldimethyl betaines include coconut-dimethyl betaine, lauryl dimethyl betaine, decyl dimethyl betaine, 2-(N-decyl-N,N-dimethyl-ammonia) acetate, 2-(N-coco N,N-dimethylammonio) acetate, myristyl dimethyl betaine, palmityl dimethyl betaine, cetyl dimethyl betaine, stearyl dimethyl betaine. For example Coconut dimethyl betaine is commercially available from Seppic under the trade name of Amonyl 265®. Lauryl betaine is commercially available from Albright & Wilson under the trade name Empigen BB/L®.

A further example of betaine is Lauryl-immino-dipropionate commercially available from Rhodia under the trade name Mirataine H2C-HA®.

Particularly preferred zwitterionic surfactants for use in the compositions of the present invention are the sulfobetaine surfactants as they deliver optimum soap scum cleaning benefits.

Examples of particularly suitable sulfobetaine surfactants include tallow bis(hydroxyethyl) sulphobetaine, cocoamido propyl hydroxy sulphobetaines which are commercially available from Rhodia and Witco, under the trade name of Mirataine CBS® and Rewoteric AM CAS 15 respectively.

Amphoteric and ampholytic detergents which can be either cationic or anionic depending upon the pH of the system are represented by detergents such as dodecylbeta-alanine, N-alkyltaurines such as the one prepared by reacting dodecylamine with sodium isethionate according to the teaching of U.S. Pat. No. 2,658,072, incorporated herein by reference, N-higher alkylaspartic acids such as those produced according to the teaching of U.S. Pat. No. 2,438,091, incorporated herein by reference, and the products sold under the trade name "Miranol", and described in U.S. Pat. No. 2,528,378, incorporated herein by reference. Additional synthetic detergents and listings of their commercial sources can be found in McCutcheon's Detergents and Emulsifiers, North American Ed. 1980, incorporated herein by reference.

Suitable amphoteric surfactants include the amine oxides. Examples of amine oxides for use herein are for instance coconut dimethyl amine oxides, C12-C16 dimethyl amine oxides. Said amine oxides may be commercially available from Clariant, Stepan, and AKZO (under the trade name Aromox®). Other suitable amphoteric surfactants for the purpose of the invention are the phosphine or sulfoxide surfactants.

Cationic surfactants suitable for use in compositions of the present invention are those having a long-chain hydrocarbyl group. Examples of such cationic surfactants include the quaternary ammonium surfactants such as alkyldimethylammonium halogenides. Other cationic surfactants useful herein are also described in U.S. Pat. No. 4,228,044, Cambre, issued Oct. 14, 1980, incorporated herein by reference.

Dye

The liquid compositions according to the present invention may be coloured. Accordingly, they may comprise a dye or a mixture thereof. Suitable dyes for use herein are acid-stable dyes. By "acid-stable", it is meant herein a compound which is chemically and physically stable in the acidic environment of the compositions herein.

The Process of Cleaning a Hard-Surface or an Object

The present invention further encompasses a process of cleaning a hard surface or an object, preferably removing limescale from said hard-surface or said object.

The process according to the present invention comprises the steps of: applying a liquid acidic hard surface cleaning composition comprising an acid system, wherein the acid system comprises formic acid and acetic acid; and mixtures thereof, onto said hard-surface or said object; leaving said composition on said hard-surface or said object to act; optionally wiping said hard-surface or object and/or providing mechanical agitation, and then rinsing said hard-surface or said object. By "hard-surface", it is meant herein any kind of surfaces typically found in and around houses like bathrooms, kitchens, basements and garages, e.g., floors, walls, tiles, windows, sinks, showers, shower plastified curtains, wash basins, WCs, dishes, fixtures and fittings and the like made of different materials like ceramic, enamel, painted and un-painted concrete, plaster, bricks, vinyl, no-wax vinyl, linoleum, melamine, Formica®, glass, any plastics, metals, chromed surface and the like. The term surfaces as used herein also include household appliances including, but not limited to, washing machines, automatic dryers, refrigerators, freezers, ovens, microwave ovens, dishwashers and so on. Preferred hard surfaces cleaned with the liquid aqueous acidic hard surface cleaning composition herein are those located in a bathroom, in a toilet or in a kitchen, basements, garages as well as outdoor such as garden furniture, gardening equipments, driveways etc.

The objects herein are objects that are subjected to limescale formation thereon. Such objects may be water-taps or parts thereof, water-valves, metal objects, objects made of stainless-steel, cutlery and the like.

The preferred process of cleaning a hard-surface or an object (preferably removing limescale from said hard-surface or said object) comprises the step of applying a composition according to the present invention onto said hard-surface or object, leaving said composition on said hard-surface or object to act, preferably for an effective amount of time, more preferably for a period comprised between 1 and 10 minutes, most preferably for a period comprised between 2 and 4 minutes; optionally wiping said hard-surface or object with an appropriate instrument, e.g. a sponge; and then preferably rinsing said surface with water.

Even though said hard-surface or object may optionally be wiped and/or agitated during the process herein, it has been surprisingly found that the process of the present invention allows good limescale removal performance without any additional mechanical wiping and/or agitation action. The lack of need for additional wiping and/or mechanical; agitation provides an added convenience for the user of the compositions herein.

In another execution of the present invention is provided a process of cleaning an object, preferably removing limescale from an object, comprising the step of immersing said object in a bath comprising a composition according to the present invention, leaving said object in said bath for the composition to act, preferably for an effective amount of time, more preferably for a period comprised between about 1 and about 10 minutes, most preferably for a period comprised between about 2 and about 4 minutes; and then preferably rinsing said object with water.

The compositions of the present invention may be contacted to the surface or the object to be treated in its neat form or in its diluted form. Preferably, the composition is applied in its neat form.

By "diluted form", it is meant herein that said composition is diluted by the user, typically with water. The composition is diluted prior use to a typical dilution level of about 10 to about 400 times its weight of water, preferably from about 10 to about 200 and more preferably from about 10 to about 100. Usual recommended dilution level is an about 1.2% dilution of the composition in water.

The compositions according to the present invention are particularly suitable for treating hard-surfaces located in and around the house, such as in bathrooms, toilets, garages, on driveways, basements, gardens, kitchens, etc., and preferably in bathrooms. It is however known that such surfaces (especially bathroom surfaces) may be soiled by the so-called "limescale-containing soils". By "limescale-containing soils" it is meant herein any soil which contains not only limescale mineral deposits, such as calcium and/or magnesium carbonate, but also soap scum (e.g., calcium stearate) and other grease (e.g. body grease). By "limescale deposits" it is mean herein any pure limescale soil, i.e., any soil or stains composed essentially of mineral deposits, such as calcium and/or magnesium carbonate.

The compositions herein may be packaged in any suitable container, such as bottles, preferably plastic bottles, optionally equipped with an electrical or manual trigger spray-head.

Limescale-Containing Soil Removal Performance Test Method:

Limescale-containing Soil Removal Performance Test Method: Limescale deposits found, e.g., in bathrooms are often not of pure limescale but a combination of limescale with organic soil (such as grease, soap scum, etc.). The limescale-containing soil removal performance of a given composition may be evaluated on limescale-containing soils comprising about 22% of total stain of organic deposit. In this test, enamel tiles are covered with a mixture of hard water salts and organic soil in a 22/78 ratio. An organic soil mixture of 25 g of isopropanol, 1.50 g of Albumin (an intravascular protein—commercially available as chicken egg albumin from Sigma Aldrich, A-5253), 1.25 g of artificial body soil (commercially available as ABS from Empirical Manufacturing company, OH, U.S.A.), 1.0 g of particulate soil (commercially available as HSW from Empirical Manufacturing company, OH, U.S.A.) and 1.25 g of calcium stearate is prepared. 9.42 g of this organic soil mixture is added to 4488 g of hard mineral water such as Ferrarrelle® mineral water (1.245 g/L dry weight). The solution is stirred until homogeneous and all solution is sprayed equally on 8 enamel tiles of 7*25 cm on a hotplate at 140° C. using a spray gun; this allows full water evaporation and deposition of the organic/inorganic soil (during this evaporation/deposition about 0.4 g of soil is deposited on each tile). Tiles are then baked for 1 h at 140° C. in an oven and aged at room temperature over night.

The test compositions are applied to a wet sponge, and used to clean the tiles with a Sheen scrub tester. The number of strokes required to clean to 100% clean is recorded. A minimum of 6 replicates can be taken with each result being generated in duplicate against the reference on each tile. Results are reported as cleaning index versus a reference composition.

Surface Safety Test Method:

0.2 ml of the composition to be evaluated for its surface safety profile are placed on delicate hard surfaces (e.g., on Blue enamel tile and on Matt/rough Stainless Steel). Afterwards, the surface is covered with a watch glass and stored at room temperature. After 16 h exposure, the watch glass is removed, the Hard surface is rinsed with water (either demineralized or tap) and then wiped dry.

Test results are reported based on visual examination (visual grading) on a scale 0 to 6 (with 0=no damage; 1=possibly visible damage: 2=minor visible damage; 3=visible damage; 4=strong visible damage; 5=very strong visible damage; 6=severe damage).

EXAMPLES

These following compositions were made comprising the listed ingredients in the listed proportions (weight %). The examples herein are met to exemplify the present invention but are not necessarily used to limit or otherwise define the scope of the present invention.

| | Examples | | | | | |
|---|---|---|---|---|---|---|
| | I | II | III | IV | V | VI |
| Acids: | | | | | | |
| Formic acid | 8.0 | 2.0 | — | 2.0 | 2.0 | 3.0 |
| Acetic acid | — | 6.0 | 8.0 | 6.0 | 6.0 | 3.0 |
| Alkaline Material: | | | | | | |
| NaOH - to pH: | — | — | — | 3.0- | — | — |
| KOH - to pH: | — | — | — | — | 3.5 | 3.6 |
| Water | up to 100% | | | | | |
| pH | <2 | <2 | <2 | 3.0 | 3.5 | 3.6 |

| | Examples | | | | | | |
|---|---|---|---|---|---|---|---|
| | VII | VIII | IX | X | XI | XII | XIII |
| Acids: | | | | | | | |
| Formic acid | 3.0 | 1.8 | 1.8 | 1.8 | 2.0 | 2.0 | 2.0 |
| Acetic acid | 6.0 | 6.0 | 8.0 | 8.0 | 8.0 | 6.0 | 7.0 |
| Lactic acid | — | — | — | 1.0 | 2.0 | — | 1.0 |
| Surfactants: | | | | | | | |
| Neodol 91-8 ® | 0.5 | 2.2 | 2.2 | 2.2 | 1.5 | 0.45 | 2.5 |
| Isalchem ® 123 AS | 2.0 | — | — | — | 1.0 | 2.0 | — |
| Polymers: | | | | | | | |
| Kelzan T | 0.4 | 0.25 | 0.25 | 0.25 | 0.25 | 0.1 | 0.4 |
| PVP | 0.25 | 0.05 | 0.05 | 0.25 | 0.05 | — | 0.25 |
| Solvent: | | | | | | | |
| n-BPP | 1.0 | — | — | — | 2.0 | — | — |
| Misc.: | | | | | | | |
| BHT | 0.03 | 0.03 | 0.03 | 0.03 | 0.05 | — | 0.03 |
| Perfume | 0.05 | 0.5 | 0.05 | 0.5 | 0.05 | 0.5 | 0.05 |
| Dye | 0.01 | 0.01 | 0.01 | 0.01 | 0.01 | 0.01 | 0.01 |

-continued

| | | | | | | | |
|---|---|---|---|---|---|---|---|
| Alkaline Material: | | | | | | | |
| KOH - to pH: | — | 3.6 | 3.0 | 3.6 | 3.6 | 3.6 | 2.6 |
| NaOH - to pH: | 3.6 | — | — | — | — | — | — |
| Water | up to 100% | | | | | | |

Formic acid, lactic acid and acetic acid are commercially available from Aldrich.

Neodol 91-8 ® is a $C_9$-$C_{11}$ EO8 nonionic surfactant, commercially available from SHELL.

Isalchem ® 123 AS is a branched alkyl-sulphates commercially available from Enichem.

n-BPP is n-butoxy propoxy propanol.

Kelzan T ® is a Xanthan gum supplied by Kelco.

PVP is a vinylpyrrolidone homopolymer, commercially available from ISP Corporation BHT is Butylated Hydroxy Toluene Example compositions I to XIII exhibit good or excellent limescale removal performance, whilst providing good surface safety on the treated surface.

Comparative Data

A comparative limescale removal experiment is conducted according to the Limescale-containing Soil Removal Performance Test Method as described herein above with the below detailed compositions (Compositions i and ii, which are compositions according to the present invention and compositions a, b and c, which are comparative example compositions). The same compositions are evaluated for their surface safety profile using the Surface safety test method both on Blue Enamel tiles and Stainless Steel as described herein above.

| | Examples | | | | |
|---|---|---|---|---|---|
| | i | ii | a | b | c |
| Acids: | | | | | |
| Formic acid | 1.8 | 1.8 | 1.3 | — | 8.0 |
| Acetic acid | 8.0 | 8.0 | — | 8.0 | — |
| Phosphoric acid | — | — | 6.3 | — | — |
| Surfactants: | | | | | |
| Neodol 91-8 ® | 2.2 | 2.2- | 2.2 | 2.2 | 2.2 |
| Alkaline Material: | | | | | |
| KOH - to pH: | 3.6 | 3.0 | — | 3.6 | 3.6 |
| Water | up to 100% | | | | |

Composition a) has no KOH added and has a pH of below 2. For the Limescale-containing Soil Removal Performance Test Method composition a was used as the Reference composition.

| | Examples | | | | |
|---|---|---|---|---|---|
| | i | ii | a | b | c |
| Surface Safety - Visual Grading: | | | | | |
| Blue Enamel Tiles | 0 | 1 | 6 | 0 | 0 |
| Stainless Steel | 0 | 1 | 4 | 0 | 3 |
| Limescale-containing Soil Removal Performance - Cleaning Index: | | | | | |
| | 103 | 128 | 100 | 80 | 100 |

(with 0 = no damage; 1 = possibly visible damage: 2 = minor visible damage; 3 = visible damage; 4 = strong visible damage; 5 = very strong visible damage; 6 = severe damage)

The above results clearly show that compositions comprising the acid system according to the present invention (Compositions i and ii) show a similar or even better limescale-containing soil removal performance as compared to compositions comprising formic acid alone (Composition c) or formic acid in combination with another acid other than acetic acid such as phosphoric acid (Composition a). At the same time, it is established that compositions comprising the acid system according to the present invention (Compositions i and ii) show a significantly improved surface safety profile both on enamel and stainless steel surfaces as compared to compositions comprising formic acid alone (Composition c) or formic acid in combination with another acid other than acetic acid such as phosphoric acid (Composition a). A composition comprising acetic acid alone (Composition b) provides in general an acceptable surface safety profile, however it provides a significantly reduced limescale-containing soil removal performance as compared to the compositions according to the present invention.

Thus, these data clearly show that the composition according to the present invention provide at the same time a good surface safety profile and good limescale removal performance.

The dimensions and values disclosed herein are not to be understood as being strictly limited to the exact numerical values recited. Instead, unless otherwise specified, each such dimension is intended to mean both the recited value and a functionally equivalent range surrounding that value. For example, a dimension disclosed as "40 mm" is intended to mean "about 40 mm".

Every document cited herein, including any cross referenced or related patent or application, is hereby incorporated herein by reference in its entirety unless expressly excluded or otherwise limited. The citation of any document is not an admission that it is prior art with respect to any invention disclosed or claimed herein or that it alone, or in any combination with any other reference or references, teaches, suggests or discloses any such invention. Further, to the extent that any meaning or definition of a term in this document conflicts with any meaning or definition of the same term in a document incorporated by reference, the meaning or definition of the same term in a document incorporated by reference, the meaning of definition assigned to that term in this document shall govern.

While particular embodiments of the present invention have been illustrated and described, it would be obvious to those skilled in the art that various other changes and modifications can be made without departing from the spirit and scope of the invention. It is therefore intended to cover in the appended claims all such changes and modifications that are within the scope of this invention.

What is claimed is:

1. A liquid acidic hard surface cleaning composition consisting of:

from about 4% to about 21% by weight of the total composition of an acid system, wherein the acid system consists of formic acid and acetic acid;

from about 75% to about 95% by weight of the total composition of water;

from about 0.05% to about 3% by weight of the total composition of a polymer selected from the group consisting of vinylpyrrolidone homopolymer, vinylpyrrolidone copolymer, and mixtures thereof;

and optionally;

a chelating agent selected from the group consisting of alkali metal ethane 1-hydroxy diphosphonates, alkylene poly(alkylene phosphonate), aminotri(methylene phosphonic acid), nitrilo trimethylene phosphonates, ethylene diamine tetra methylene phosphonates, diethylene triamine Penta methylene phosphonates, and mixtures thereof;

a surfactant;

an alkaline material selected from the group consisting of sodium hydroxide, potassium hydroxide, and mixtures thereof;

xanthan gum;

perfumes;

dyes; and mixtures thereof.

2. A composition according to claim 1, wherein said composition has a pH between about 3 and about 4.

3. A composition according to claim 1, wherein said formic acid is present in an amount from about 1% to about 6%, by weight of the total composition.

4. A composition according to claim 1, wherein said acetic acid is present in an amount from about 3% to about 15%, by weight of the total composition.

5. A composition according to claim 1, wherein said acetic acid is present in an amount from about 3% to about 10%, by weight of the total composition of.

6. A composition according to claim 1 wherein the chelating agent is present in the composition.

7. A composition according to claim 6 wherein the chelating agent is alkali metal ethane 1-hydroxy diphosphonate.

8. A composition according to claim 1, wherein the surfactant is a nonionic surfactant, said nonionic surfactant is a condensation product of ethylene and/or propylene oxide and an alcohol having a straight alkyl chain, wherein the alkyl chain is from about 6 carbon atoms to about 22 carbon atoms, and wherein the degree of ethoxylation/propoxylation is from about 5 to about 12.

9. A composition according to claim 1 wherein the surfactant is selected from the group consisting of anionic surfactants; cationic surfactants; amphoteric surfactants; zwitterionic surfactants; and mixtures thereof.

10. A composition according to claim 1 wherein the alkaline material is present in the composition.

11. The composition of claim 10, wherein the alkaline material is potassium hydroxide.

12. The composition of claim 1 wherein the xanthan gum is present in the composition.

13. A process of safely removing limescale from a hard surface comprising the steps of:

a. applying a liquid acidic hard surface cleaning composition, according to claim 1, onto said hard-surface or said object;

b. leaving said composition on said hard-surface to act; and c. optionally wiping said hard-surface.

14. A process according to claim 13, wherein said hard surface is located in a room selected from the group consisting of a bathroom, and a kitchen.

15. A process of cleaning or removing limescale from an object comprising the steps of:

d. immersing said object in a bath comprising a composition according to claim 1;

e. leaving said object in said bath for said composition to act;

f. rinsing said object.

16. A liquid acidic hard surface cleaning composition consisting of:

from about 4% to about 21% by weight of the total composition of an acid system, wherein the acid system consists of formic acid, acetic acid, and lactic acid;

from about 75% to about 95% by weight of the total composition of water;

xanthan gum;

from about 0.05% to about 3% by weight of the total composition of a polymer selected from the group consisting of vinylpyrrolidone homopolymer, vinylpyrrolidone copolymer, and mixtures thereof;

and optionally:

a chelating agent selected from the group consisting of alkali metal ethane 1-hydroxy diphosphonates, alkylene poly(alkylene phosphonate), aminotri(methylene phosphonic acid), nitrilo trimethylene phosphonates, ethylene diamine tetra methylene phosphonates, diethylene triamine penta methylene phosphonates, and mixtures thereof;

a surfactant;

an alkaline material selected from the group consisting of sodium hydroxide, potassium hydroxide, and mixtures thereof;

perfumes;

dyes; and mixtures thereof.

17. A composition according to claim 16 wherein the alkaline material is present in the composition.

18. A composition according to claim 17 wherein the alkaline material is potassium hydroxide.

* * * * *